US006195073B1

(12) United States Patent
Lin

(10) Patent No.: US 6,195,073 B1
(45) Date of Patent: Feb. 27, 2001

(54) APPARATUS AND METHOD FOR GENERATING PLASMA IN A PLASMA DISPLAY PANEL

(75) Inventor: Chu-Shan Lin, Taichung (TW)

(73) Assignee: Acer Display Technology, Inc., Park Hsinchu (TW)

( * ) Notice: Subject to any disclaimer, the term of this patent is extended or adjusted under 35 U.S.C. 154(b) by 0 days.

(21) Appl. No.: 09/143,453

(22) Filed: Aug. 28, 1998

(51) Int. Cl.[7] ..... G09G 3/28; H01J 1/62; H01J 17/49

(52) U.S. Cl. ..... 345/67; 345/67; 345/60; 345/66; 313/484; 313/584; 313/585; 313/587

(58) Field of Search ..... 345/60, 66, 67; 313/484, 584, 585, 587

(56) References Cited

U.S. PATENT DOCUMENTS

| | | | | |
|---|---|---|---|---|
| 3,881,129 | * | 4/1975 | Nakayama et al. | 345/67 |
| 3,952,230 | * | 4/1976 | Sakai | 345/61 |
| 4,914,352 | * | 4/1990 | Gay et al. | 315/169.4 |
| 5,369,338 | * | 11/1994 | Kim | 313/584 |
| 5,805,122 | * | 9/1998 | Bongaerts et al. | 345/60 |
| 6,020,687 | * | 2/2000 | Hirakawa et al. | 315/169.1 |

* cited by examiner

*Primary Examiner*—Mark R. Powell
*Assistant Examiner*—Ryan Yang
(74) *Attorney, Agent, or Firm*—Winston Hsu

(57) ABSTRACT

The present invention relates to a plasma generation method of a plasma display panel. The plasma display panel comprises a first substrate and a second substrate positioned in parallel with each other, an ionizable gas filled between the two substrates, and a plurality of first, second, third and fourth electrodes installed on the two substrates. The first and second electrodes are alternately installed in parallel on the first substrate. The third electrodes are installed on the second substrate perpendicular to the first and second electrodes. An area between one of the third electrodes and a pair of neighboring first and second electrodes define a display unit for generating plasma from the ionizable gas in the display unit and driving the plasma. The third electrode of each display unit is used for determining if the plasma within the display unit should remain. The first and second electrodes are used for driving the plasma in the display unit back and forth so as to maintain displays of the display unit. Each of the fourth electrodes is installed close to each of the first electrodes. The plasma generation method comprises charging a predetermined firing voltage between the first and fourth electrodes to transform the ionizable gas in the display unit into an initial plasma, and charging a predetermined voltage between the first and second electrodes for spreading the initial plasma over the display unit.

12 Claims, 3 Drawing Sheets

APPARATUS AND METHOD FOR GENERATING PLASMA IN A PLASMA DISPLAY PANEL

BACKGROUND OF THE INVENTION

1. Field of the Invention

The present invention relates to a plasma display panel, and more particularly, to a plasma display panel with a low firing voltage.

2. Description of the Prior Art

The plasma display panel (PDP) has great potential in the big-size flat display market. A prior art plasma display panel requires a high firing voltage to transform an ionizable gas such as argon into a plasma. Driving the plasma display panel at high voltage not only requires expensive driving and control components, but may also damage the components thus shortening their life spans.

Please refer to FIG. 1. FIG. 1 is a sectional view of a prior art plasma display panel 10. The plasma display panel 10 comprises a first substrate 12 and a second substrate 18 positioned in parallel with each other, an ionizable gas 27 filled between the two substrates 12 and 18, a plurality of first electrodes 26, a plurality of second electrodes 28, and a plurality of third electrodes 20. The first electrodes 26 and the second electrodes 28 are alternately installed in parallel on the first substrate 12. The third electrodes 20 are installed on the second substrate 18 perpendicular to the first and second electrodes 26, 28. The plasma display panel 10 further comprises a dielectric layer 14 installed above the first substrate 12, a protective layer 16 coated above the dielectric layer 14, a plurality of fluorescent phosphorus layers 22 installed above the third electrodes 20 for generating fluorescent light, and a plurality of rib 24 installed on the third electrodes 20 for isolating two adjacent fluorescent phosphorus layers 22.

Each area between one of the third electrodes 20 and a pair of neighboring first and second electrodes 26,28 defines a display unit 30 for generating plasma from the ionizable gas 27 in the display unit and driving the plasma. When a high voltage is charged between the first and second electrodes 26, 28, the electric field between the two electrodes 26, 28 causes the electrons of the ionizable gas 27 to ionize thereby generating spatial charges. After the spatial charges are generated, the third electrode 20 interacts with the first electrode 26 or second electrode 28 to generate a plasma and determine if the generated wall charges have a sufficient density to light the plasma. The wall charge density is the critical factor in maintaining the display unit 30 in the bright (on) state or in the dark (off) state. If it is decided not to maintain the display unit 30 in the bright state, the spatial charges of the display unit 30 are quickly restored to normal ionizable gas 27 (non-ionized state). If it is decided to maintain the display unit 30 in the bright state, the first and second electrodes 26, 28 drive the plasma in the display unit 30 back and forth for continuous radiating ultraviolet rays. When ultraviolet rays are radiated to the fluorescent phosphorus layer 22, the fluorescence will gleam, and the gleamed light emitted by the display unit 30 will be seen by the user through the transparent substrate 12.

The first and second electrodes 26, 28 comprise opaque conductors 261, 281 made of CrCuCr material and transparent conductors 262, 282 made of ITO material. The CrCuCr material is highly conductive but is opaque. The ITO material is partially transparent but has higher resistance. The firing voltage of the display unit 30 is related to the distance between the ITO material 262 of the first electrode 26 and the ITO material 282 of the second electrode 28. Although the transparent conductors 262, 282 formed by ITO material will absorb part of the visible light and are associated with higher resistance, they can be used for shortening the distance between the first and second electrodes 26, 28 so as to reduce the firing voltage of the display unit 30.

Although the first and second electrodes 26, 28 formed by the CrCuCr and ITO materials reduce the firing voltage of the display unit 30, the absorption of visible light by the transparent conductors 262, 282 formed by the ITO material will decrease the brightness of the display, and the resistance of the ITO material will result in a loss of energy.

SUMMARY OF THE INVENTION

It is therefore a primary objective of the present invention to provide a plasma display panel with a low firing voltage to solve the aforementioned problems.

In a preferred embodiment, the present invention provides a plasma generation method of a plasma display panel, the plasma display panel comprising a first substrate and a second substrate positioned in parallel with each other, an ionizable gas filled between the two substrates, and a plurality of first, second, third and fourth electrodes installed on the two substrates, the first and second electrodes being alternately installed in parallel on the first substrate, the third electrodes being installed on the second substrate perpendicular to the first and second electrodes, an area between one of the third electrodes and a pair of neighboring first and second electrodes defining a display unit for generating plasma from the ionizable gas in the display unit and driving the plasma, the third electrode of each display unit being used for determining whether the plasma within the display unit should remain or not, and the first and second electrodes being used for driving the plasma in the display unit back and forth so as to maintain displays of the display unit, each of the fourth electrodes being installed close to each of the first electrodes, the plasma generation method comprising:

step (1) charging a predetermined firing voltage between the first and fourth electrodes to transform the ionizable gas in the display unit into an initial plasma; and step (2) charging a predetermined voltage between the first and second electrodes for spreading the initial plasma over the display unit.

It is an advantage of the present invention that the distance between each fourth electrode and first electrode of the plasma display panel is much shorter than that between each first electrode and second electrode of the prior art plasma display panel. Thus, the firing voltage of the display unit of the plasma display panel is greatly reduced.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 2:
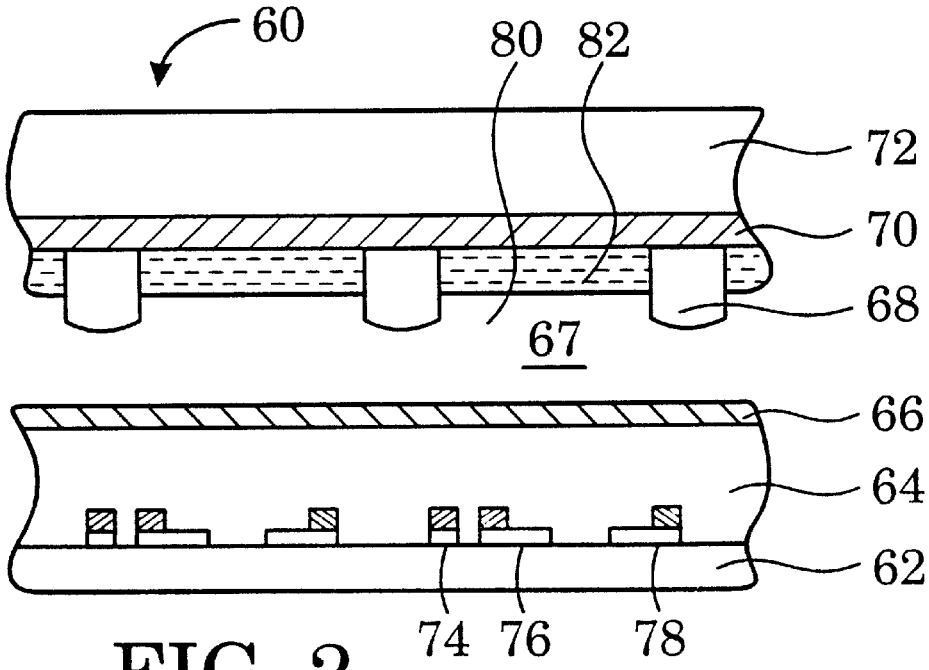
FIG. 2 is a sectional view of a plasma display panel according to the present invention.

Please refer to FIG. 2. FIG. 2 is a sectional view of a plasma display panel 60 according to the present invention. The plasma display panel 60 comprises a first substrate 62 and a second substrate 72 positioned in parallel with each other, an ionizable gas 67 filled between the two substrates 62 and 72, a plurality of first electrodes 74, second electrodes 78, and fourth electrodes 76 installed on the first substrate 62, a plurality of third electrodes 70 on the second substrate 72, a dielectric layer 64 coated on the first substrate 62, a protecting layer 66 coated above the dielectric layer 64, a plurality of fluorescent phosphorus layer 82 installed above the third electrodes 70 for generating fluorescent light, and a plurality of rib 68 installed on the third electrodes 70 for isolating two neighboring fluorescent phosphorus layers 82.

The first electrodes 74, fourth electrodes 76 and second electrodes 78 are alternately installed in parallel on the first substrate 62. Each fourth electrode 76 is installed between each first and each second electrodes 74, 78. The third electrodes 70 are installed on the second substrate 72 perpendicular to the first and second electrodes 74, 78, and each fourth electrode 76 is installed close to each first electrode 74. Each area between one of the third electrodes 70 and a pair of neighboring first and second electrodes 74,78 defines a display unit 80 for generating plasma from the ionizable gas 67 in the display unit and driving the plasma.

Figure 1:
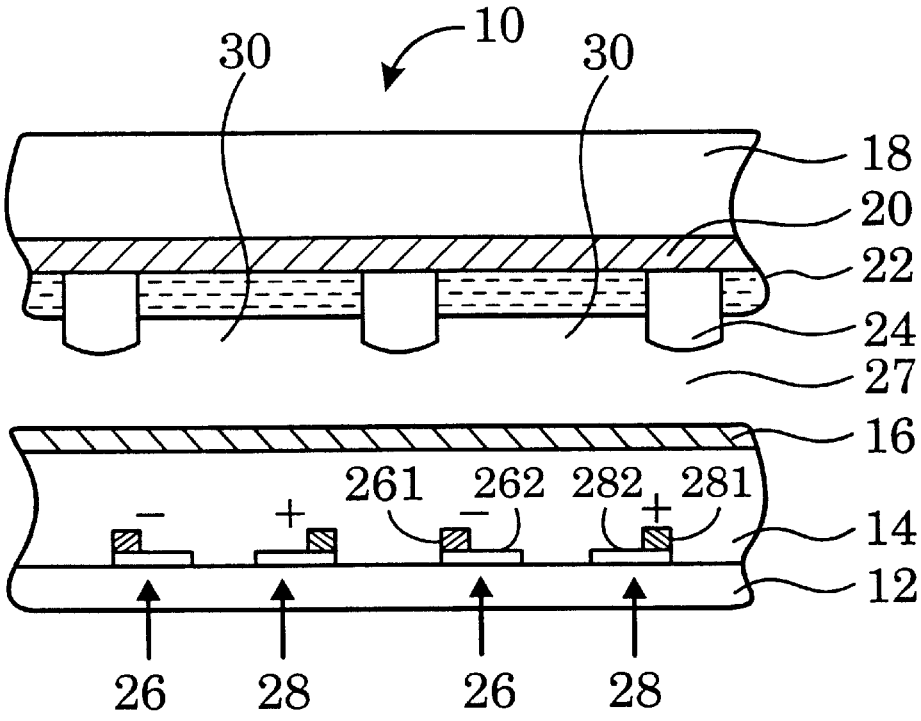
FIG. 1 PRIOR ART
FIG. 1 is a sectional view of a prior art plasma display panel.

Each of the fourth electrodes 76 is installed between the first and second electrodes 74,78 of each display unit. The distance between each first and fourth electrode 74, 76 is much shorter than that between each first and second electrode 26, 28 of the plasma display panel 10 shown in FIG. 1. Because a shorter distance between two electrodes is associated with a greater electric field and thus an increased number of ionized charges, the firing voltage of the display unit 80 will be reduced greatly.

Figure 3:
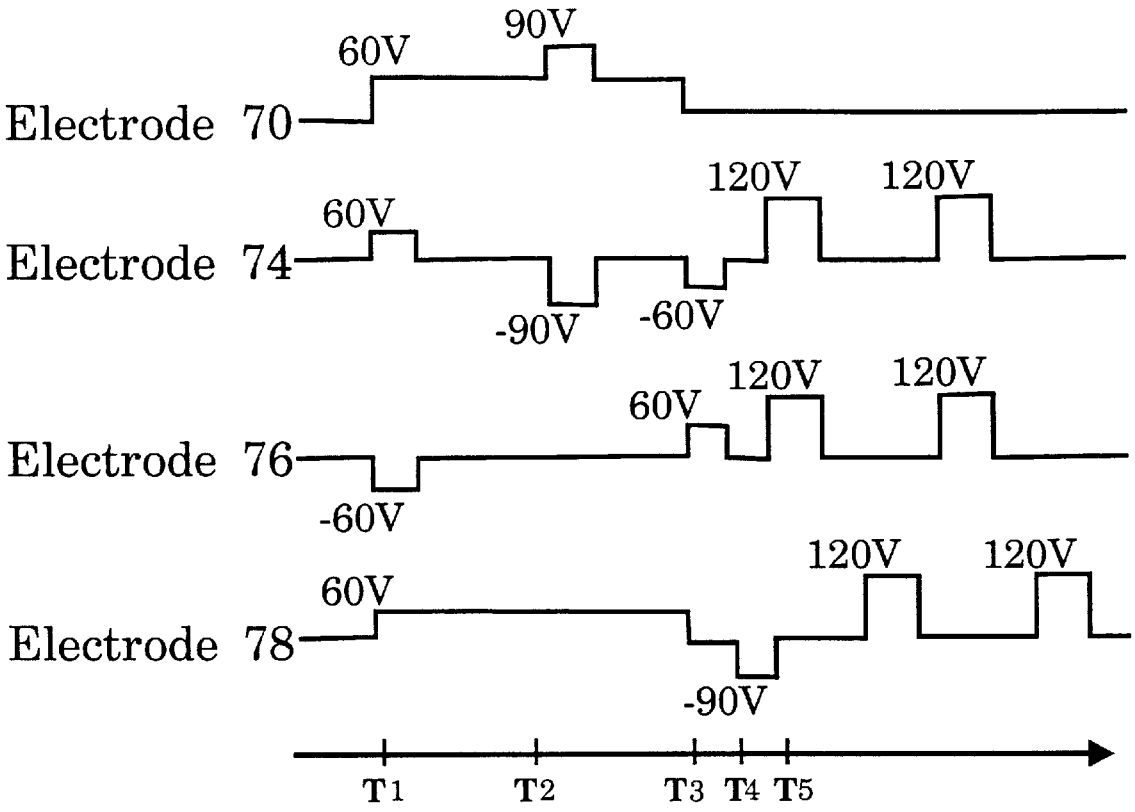
FIG. 3 is a timing diagram showing the voltages of the electrodes shown in FIG. 2.

Please refer to FIG. 3. FIG. 3 is a timing diagram showing the voltages of the electrodes 70, 74, 76, 78 of the plasma display panel 60. In each display unit 80 at time t1, the first electrode 74 is raised to 60V while the fourth electrode 76 is dropped to −60V for generating an initial plasma to increase the spatial charges and the wall charge density, and the third electrode 70 is raised to 60V for interacting with the fourth electrode 76 so as to light up a display unit 80. At time t2, a prior art process called addressing and will not be further described here. At time t3, in order to maintain the light emitting state of the display unit 80, the first electrode 74 is dropped to −60V, the fourth electrode 76 is raised to 60V, and the second electrode 78 is further decreased to −90V at time t4 to strengthen the wall charge density needed for maintaining the light emitting state of the display unit 80. After time t5, the first electrode 74 and the second electrode 78 is raised to 120V alternately for driving the plasma lightened within the display unit 80 back and forth for sustaining the display of the display unit 80.

Figure 4:
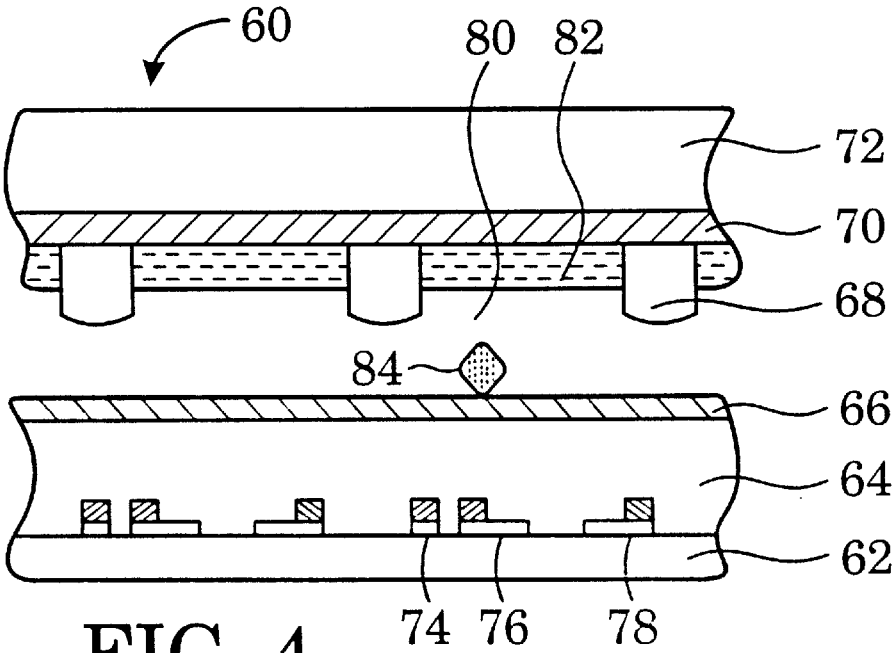
FIGS. 4 and 5 demonstrate a method for generating a plasma within a display unit shown in FIG. 2.
Figure 5:
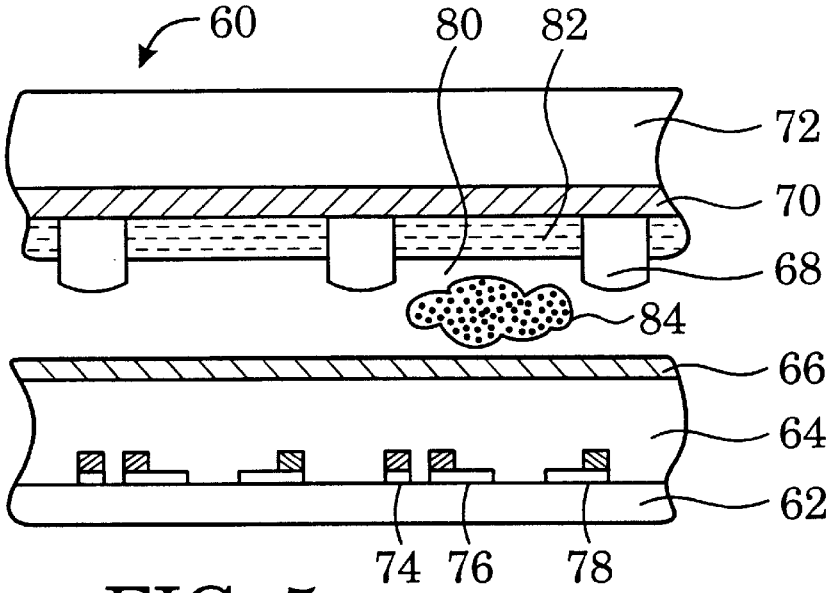

Please refer to FIGS. 4 and 5. FIGS. 4 and 5 demonstrate a method for generating a plasma within a display unit 80. FIG. 4 shows that when charging a firing voltage between the first and fourth electrodes 74, 76, the ionizable gas 67 in the display unit 80 generates an initial plasma 84 under influence of the generated electric field. FIG. 5 shows that when a firing voltage is charged between the first and second electrodes 74, 78, the initial plasma 84 spreads over the display unit 80.

Figure 6:
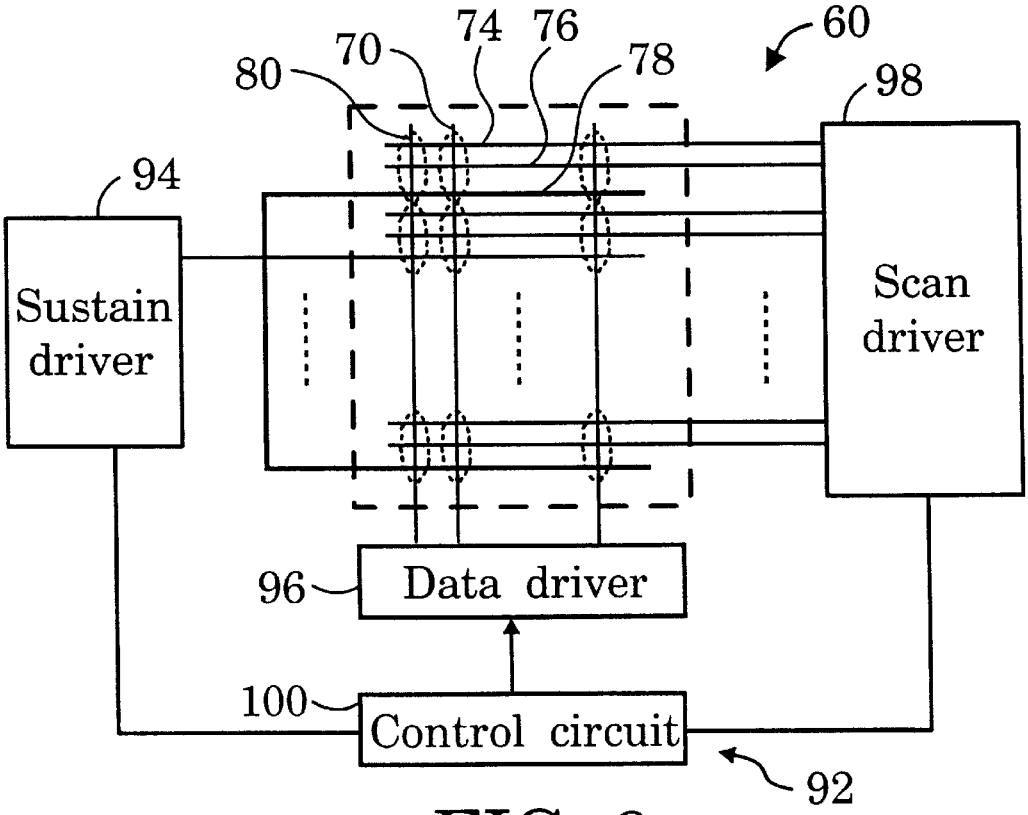
FIG. 6 is a structural diagram of the plasma display panel in FIG. 2.

Please refer to FIG. 6. FIG. 6 is a structural diagram of the plasma display panel 60. The plasma display panel 60 comprises a plurality of first electrodes 74, second electrodes 78, third electrodes 70 and fourth electrodes 76, and a display control circuit 92 connected to the four electrodes for controlling the operations of each electrode.

The first electrodes 74, fourth electrodes 76 and second electrodes 78 are alternately installed in parallel with each other, and the third electrodes 70 are installed perpendicular to the first, fourth, and second electrodes 74, 76, 78. Each area between one of the third electrodes 70 and a pair of neighboring first and second electrodes 74,78 defines a display unit 80 for generating plasma from the ionizable gas in the display unit and driving the plasma.

The display control circuit 92 comprises a sustain driver 94 electrically connected to the second electrode 78 of each display unit 80, a scan driver 98 electrically connected to the first and fourth electrodes 74, 76 of each display unit 80, a data driver 96 electrically connected to the third electrode 70 of each display unit 80, and a control circuit 100 for controlling operations of the sustain driver 94, scan driver 98, and data driver 96. The scan driver 98 drives the first and fourth electrodes 74, 76 of each display unit 80 to generate an initial plasma, interacts with the data driver 96 to determine if the plasma should remain in the display unit 80, and interacts with the sustain driver 94 to drive the plasma in the display unit 80 back and forth between the first and second electrodes 74, 78 for maintaining the displays of the display unit 80.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma generation method of a plasma display panel, the plasma display panel comprising a first substrate and a second substrate positioned in parallel with each other, an ionizable gas filled between the two substrates, and a plurality of first, second, third and fourth electrodes installed between the two substrates, the first and second electrodes being alternately installed in parallel on the first substrate, the third electrodes being installed on the second substrate perpendicular to the first and second electrodes, an area between one of the third electrodes and a pair of neighboring first and second electrodes defining a display unit for generating plasma from the ionizable gas in the display unit, each of the fourth electrodes being installed close to a neighboring first electrode, the plasma generation method comprising:

step (1) charging a first predetermined voltage between the first and fourth electrodes to transform the ionizable gas in the display unit into an initial plasma; and step (2) before the initial plasma has disappeared, charging a second predetermined voltage between the first and second electrodes for spreading the initial plasma over the display unit.

2. The plasma generation method of claim 1 wherein the fourth electrodes are installed on the first substrate.

3. The plasma generation method of claim 2 wherein each of the fourth electrodes is installed between the first and second electrodes of each display unit.

4. The plasma generation method of claim 1 wherein the plasma display panel further comprises a scan driver connected to the first electrode and a sustain driver connected to the second electrode of the display unit for driving the plasma in the display unit back and forth to sustain the display of the display unit.

5. The plasma generation method of claim 4 wherein the plasma display panel further comprises a data driver electrically connected to the third electrode of the display unit for determining whether the initial plasma spread in the display unit should remain or not.

6. The plasma generation method of claim 1 wherein each of the fourth electrodes is closely installed next to the neighboring first electrode so as to reduce the firing voltage of each display unit.

7. A plasma display panel comprising:

first and second substrates positioned in parallel with each other;

an ionizable gas filled between the two substrates;

a plurality of first, second, third and fourth electrodes installed between the two substrates; and a display control circuit electrically connected to the four electrodes for controlling operations of the four electrodes;

wherein the first and second electrodes are alternately installed in parallel on the first substrate, the third electrodes are installed on the second substrate perpendicular to the first and second electrodes, each of the fourth electrodes is installed in parallel and close to a neighboring first electrode, and an area between one of the third electrodes and a pair of neighboring first and second electrodes defines a display unit for generating plasma from the ionizable gas in the display unit and driving the plasma;

wherein in each display unit, when applying a first predetermined voltage between the first and fourth electrodes, an initial plasma is generated between the first and fourth electrodes; and wherein when applying a second predetermined voltage between the first and second electrodes, the initial plasma is spread over the display unit by the second predetermined voltage.

8. The plasma display panel of claim 7 wherein the fourth electrodes are installed on the first substrate.

9. The plasma display panel of claim 8 wherein each of the fourth electrodes is installed between the first and second electrodes of each display unit.

10. The plasma display panel of claim 7 wherein the display control circuit comprises a scan driver connected to the first electrode and a sustain driver connected to the second electrode of the display unit for driving the plasma in the display unit back and forth to sustain the display of the display unit.

11. The plasma display panel of claim 10 wherein the display control circuit further comprises a data driver electrically connected to the third electrode of the display unit for interacting with the scan driver so as to determine whether the plasma generated in the display unit should remain or not.

12. The plasma display panel of claim 7 wherein each of the fourth electrodes is closely installed next to the neighboring first electrode so as to reduce the firing voltage of each display unit.

* * * * *